US005802975A

United States Patent [19]

Prem et al.

[11] Patent Number: 5,802,975

[45] Date of Patent: Sep. 8, 1998

[54] DEVICE FOR MANIPULATING SLEEVES ON CYLINDERS

[75] Inventors: Wolfgang Prem, Kutzenhausen; Anton Stadlmair, Kühbach, both of Germany

[73] Assignee: MAN Roland Druckmaschinen AG, Offenbach am Main, Germany

[21] Appl. No.: 972,920

[22] Filed: Nov. 18, 1997

Related U.S. Application Data

[63] Continuation of Ser. No. 601,470, Feb. 14, 1996, abandoned, which is a continuation-in-part of Ser. No. 346,773, Nov. 30, 1994, abandoned.

[30] Foreign Application Priority Data

Dec. 3, 1993 [DE] Germany ..... 43 41 246.7

[51] Int. Cl.[6] ..... B41F 27/00; B41F 30/00; B65H 23/00

[52] U.S. Cl. ..... 101/375; 101/217; 101/219; 29/895.23

[58] Field of Search ..... 101/116, 141, 101/142, 148, 153, 216–220, 348, 375, 376, 389.1, 477, 479; 492/4, 48; 29/895.23

[56] References Cited

U.S. PATENT DOCUMENTS

| | | | |
|---|---|---|---|
| 1,355,481 | 10/1920 | Lee | 29/895.23 |
| 3,812,562 | 5/1974 | Lovett | 492/48 |
| 4,030,415 | 6/1977 | Fellows | 101/389.1 |
| 4,119,032 | 10/1978 | Hollis | 101/216 |
| 4,295,421 | 10/1981 | Abendroth et al. | 101/216 |
| 4,461,663 | 7/1984 | Tachibana et al. | 101/375 |
| 4,549,923 | 10/1985 | Tachibana et al. | 156/423 |
| 4,807,527 | 2/1989 | Knauer | 101/216 |
| 4,823,693 | 4/1989 | Köbler | 101/218 |
| 4,913,048 | 4/1990 | Tittgemeyer | 101/141 |
| 5,005,475 | 4/1991 | Knauer | 101/218 |
| 5,072,504 | 12/1991 | Thompson | 29/895.23 |
| 5,241,903 | 9/1993 | Lampic | 101/216 |
| 5,241,905 | 9/1993 | Guaraldi et al. | 101/216 |
| 5,289,769 | 3/1994 | Lewis | 101/218 |

FOREIGN PATENT DOCUMENTS

| | | | |
|---|---|---|---|
| 132771 | 11/1978 | Germany | 101/217 |
| 0 277545 | 8/1988 | Germany . | |
| 228151 | 11/1985 | Japan | 101/375 |

*Primary Examiner*—Stephen R. Funk
*Attorney, Agent, or Firm*—Cohen, Pontani, Lieberman & Pavane

[57] ABSTRACT

A device for manipulating sleeves, including sleeves serving as printing forms or as rubber blankets as well as screened sleeves, from outside the printing mechanism without removing the paper web which has been drawn in. The device includes a sleeve gripping system associated with each cylinder intended to receive a sleeve. A force mechanism is activated by this sleeve gripping system to grip the sleeve within the printing mechanism in a frictional or positive engagement. When gripped, the respective sleeve can be displaced on the cylinder in the axial direction in a correctly positioned manner by the gripping system at least between the side walls of the printing mechanism.

8 Claims, 5 Drawing Sheets

DEVICE FOR MANIPULATING SLEEVES ON CYLINDERS

This is a continuation of application Ser. No. 08/601,470, filed Feb. 14, 1996, which is a continuation-in-part of application Ser. No. 08/346,773, filed Nov. 30, 1994, both now abandoned.

BACKGROUND OF THE INVENTION

1. Field of the Invention

The invention is directed to a device for manipulating sleeves on cylinders, in particular for the attachment of sleeves serving as printing forms or rubber blankets to printing mechanism cylinders in a rotary printing machine. The cylinders intended to receive sleeves are supported in a cantilevered manner at one end which is mounted so as to be stationary in the printing machine. The other end can be exposed so that the sleeve can be slipped onto or pulled off of the cylinder in question via the exposed end.

2. Description of the Prior Art

Printing mechanism cylinders and sleeves of this type, including sleeve-shaped printing forms for a form cylinder or rubber-coated sleeves for an impression cylinder, are already known, e.g., from European Patent Application EP 02 77 545 A2.

In order to exchange sleeves, an air cushion is produced between the cylinder jacket and the inside wall of the sleeve by means of compressed air flowing from the core of the cylinder. The sleeve can be shifted onto the cylinder in the axial direction on this air cushion. When the compressed air is cut off, a positive engagement is effected between the sleeve and the cylinder on the principle of a shrinkage fit. The sleeve may be removed from the cylinder again by resuming the supply of compressed air, i.e., the sleeve is attached to or removed from the sleeve in this way. For this purpose, a side wall of the printing mechanism must have an opening whose diameter is greater than the diameter of the printing mechanism cylinder. Every cylinder intended to accept a sleeve is mounted in a cantilevering manner at one end which is supported in the printing press so as to be stationary, while the other end can be exposed to form a side wall opening. To this end, a jaw chuck with two jaws is provided, these jaws being displaceable in opposite directions in the plane of this side wall of the printing mechanism.

In order to guide the sleeve into and out of the opened side wall of the printing mechanism it has always been necessary to remove the paper web passing between the impression cylinders so that the operator, who stands in the printing mechanism, can push the sleeve through the side wall opening for disassembly or pull it through this opening for assembly. Lengthy set-up times were required to carry out these steps.

SUMMARY OF THE INVENTION

Therefore, the object of the present invention is to provide a device for manipulating sleeves on cylinders, in particular for printing mechanism cylinders in a rotary printing machine of the generic type which device takes the sleeves, e.g., sleeves serving as printing forms or rubber blankets as well as screened sleeves, out of the printing mechanism without manual manipulation within the printing mechanism.

Pursuant to this object, and others which will become apparent hereafter, one aspect of the present invention resides in a sleeve manipulating device having a sleeve gripping system associated with each cylinder that is intended to receive sleeves. The gripping system actuates force means to grip the sleeve within the printing mechanism in a frictional or positively engaging manner. The gripped sleeve can be displaced, on the cylinder in the axial direction in a correctly positioned manner, by the gripping system between the side walls of the printing mechanism.

In a particularly advantageous manner, with the assistance of the paper swiveling device associated with each impression cylinder, the tensioned paper web is allowed to remain between the impression cylinders, in contrast to previous practice, while the sleeves serving as rubber blankets are mounted or removed.

By providing a system for displacing the sleeve on the cylinder in the axial direction for all cylinders intended to accept sleeves, it is possible for the sleeves which are to be removed to be displaced axially on the respective printing mechanism cylinder in such a way that they can easily be mounted or removed through a side wall opening by the operator or by an automatic feeding and gripping device.

Pursuant to another embodiment of the invention, a paper web swiveling device is provided for swiveling a paper web, which has been drawn into the printing mechanism, away from the impression cylinder. The paper web swiveling device includes at least one swivel arm which is articulated to at least one strip arranged parallel to the axis of the impression cylinder. The paper web can be moved away from the impression cylinder via the strip when the swivel arm is actuated.

In yet another embodiment of the invention the swivel arm is a pneumatic cylinder whose piston rod has the articulated strip attached thereto so that the paper web can be pressed away from the impression cylinder.

In a further embodiment of the invention the sleeve gripping system includes a guide rail that extends parallel to the cylinder axis. A displaceable guide member is mounted on the guide rail so as to be engageable with the sleeve for moving the sleeve. A drive is articulated to the guide member to displace the guide member together with the sleeve. The drive includes a pneumatic cylinder and a piston rod articulated to the guide member so that the sleeve is movable on the cylinder by a defined distance.

In still another embodiment of the invention, the guide member is constructed as a clamping piece which has a friction lining mounted thereon. The clamping piece is a control pin which is movable vertically relative to the cylinder axis against a pressure spring for contacting the sleeve. The movement of the control pin is controlled by a groove geometry in the guide rail so that the friction lining of the clamping piece can be brought into contact with the sleeve and moved away from the sleeve by upward and downward motion of the control pin.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
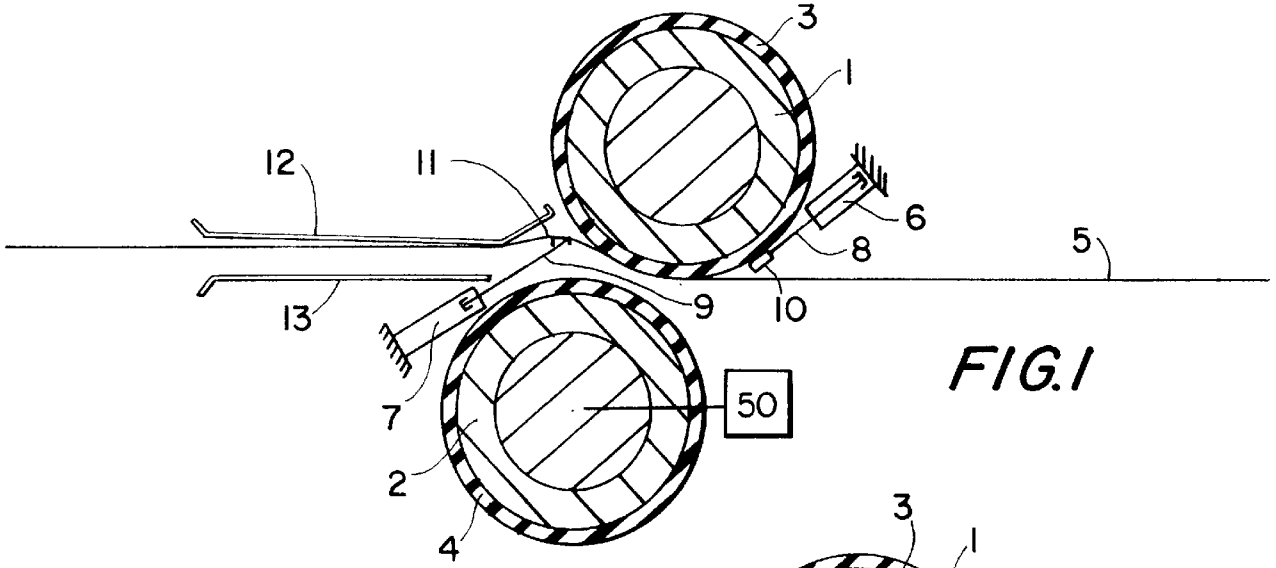
FIGS. 1 and 2, respectively, show a cross section through two impression cylinders of a printing mechanism with an inserted paper web and alternately acting paper swiveling devices.
Figure 2:
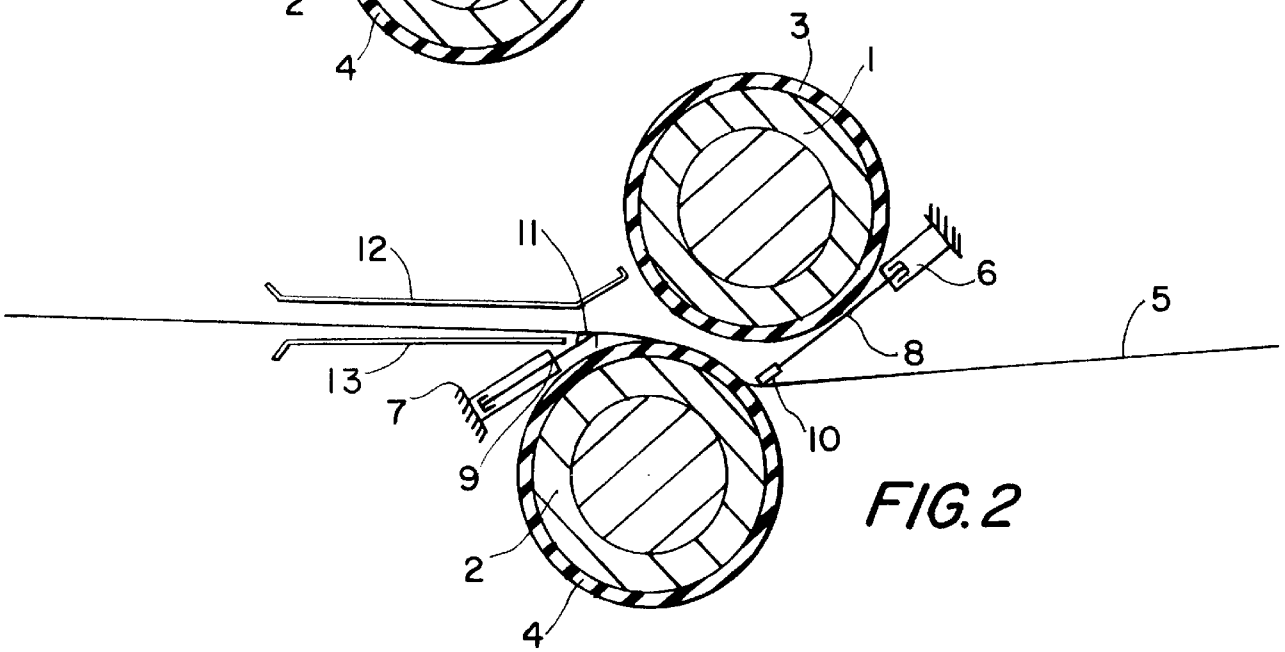

FIGS. 1 and 2 show two impression cylinders 1, 2 of a printing mechanism which have been disconnected from printing operation for the purpose of changing sleeves and have attached sleeves 3, 4 serving as rubber blankets. A paper web 5 has been drawn in between the impression cylinders 1, 2. A swivel arm 6, 7 in the form of a pneumatic cylinder with a piston rod 8, 9 which can travel tangentially to the associated cylinder 1 and 2, respectively, is secured in the printing mechanism on both sides of the paper web 5. A strip 10, 11 extending parallel to the axis of the respective impression cylinder 1, 2 is articulated at each piston rod 8, 9.

The strip 10, 11 can be moved by the pneumatic cylinder 6, 7 in such a way that after the impression cylinder 1, 2 whose sleeve is to be exchanged or mounted has been disconnected from printing operation in a known manner the paper web 5 running through the printing mechanism can be swiveled away and simultaneously pressed against the opposite impression cylinder 2, 1 in the printing gap.

Paper guide plates 12, 13 are arranged at both sides of the paper web 5 upstream of the printing gap to assist in these steps.

In this way, the paper web 5 in the printing gap can be swiveled away from the impression cylinder 2 located below it and pressed against the impression cylinder 1 located above it so that the sleeve 4 serving as the rubber blanket can be removed or mounted without contacting or damaging the paper web 5 (FIG. 1).

The same process is carried out to remove the sleeve 3 from or mount it on the cylinder 1 located above the web 5. In this case, the tensioned paper web 5 is swiveled away from cylinder 1 (FIG. 2).

Figure 3:
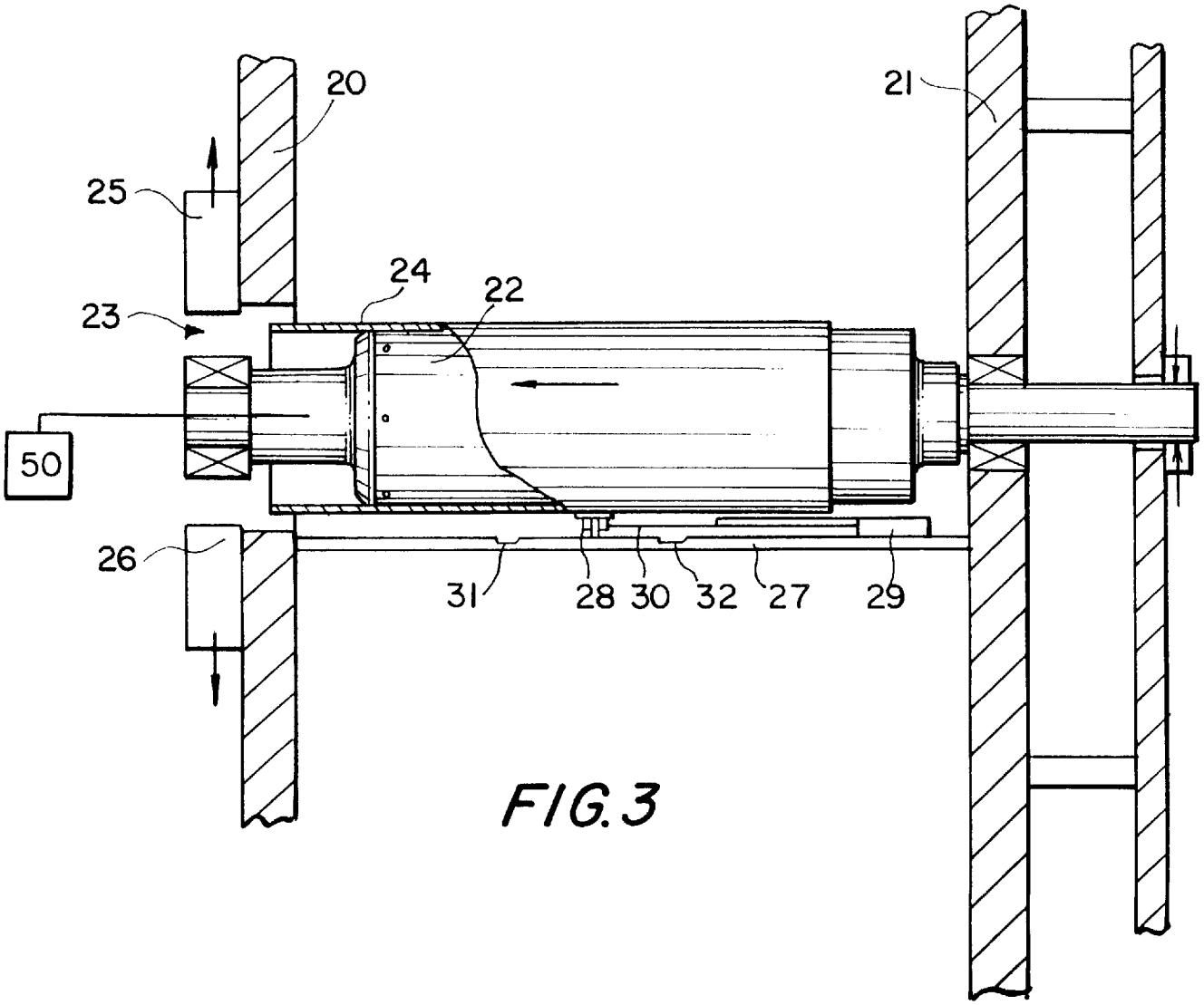
FIG. 3 is a side view of a printing mechanism cylinder with a system for displacing a sleeve on the cylinder in the axial direction.

FIG. 3 shows a printing mechanism cylinder 22, e.g., a form cylinder or impression cylinder, which is supported between two side walls 20, 21. The cylinder 22 must be supported, in a known manner which is not explained here in more detail, so as to be displaceable or swivelable for adjusting to other cylinders. The cylinder 22 is supported at one end in a stationary floating or cantilevered manner in the printing machine, in this case, at the side wall 21 of the printing mechanism. The other end of the cylinder 22 can be exposed. At the exposed end, in this case the side wall 20 of the printing mechanism, a side wall opening 23 is provided whose diameter is greater than the diameter of the sleeve 24 arranged on the cylinder 22.

In order to expose the cylinder 22, the side wall 20 is provided with a jaw chuck having two jaws 25, 26 which can be displaced in opposite directions according to the arrows in the plane of side wall 20 so that it is possible to slide the sleeve 24 through this side wall opening 23.

A guide rail 27 is inserted between the two side walls 20, 21 and extends parallel to the axis of cylinder 22. A displaceable guide member 28 which faces the cylinder surface and can be brought into contact with the sleeve 24 is placed on the guide rail 27. The guide member 28 is articulated at a drive 29, in the form of a pneumatic cylinder, by means of a piston rod 30, the drive 29 being secured on the guide rail 27.

The guide rail 27, the guide member 28, the drive 29 and the piston rod 30 form a sleeve gripping system 27, 28, 29, 30 for displacing the sleeve 24 in a correctly positioned manner. This sleeve gripping system is preferably integrated in a deflecting rod to protect the fingers of the operator from the printing gap between two oppositely located printing mechanism cylinders.

Figure 4:
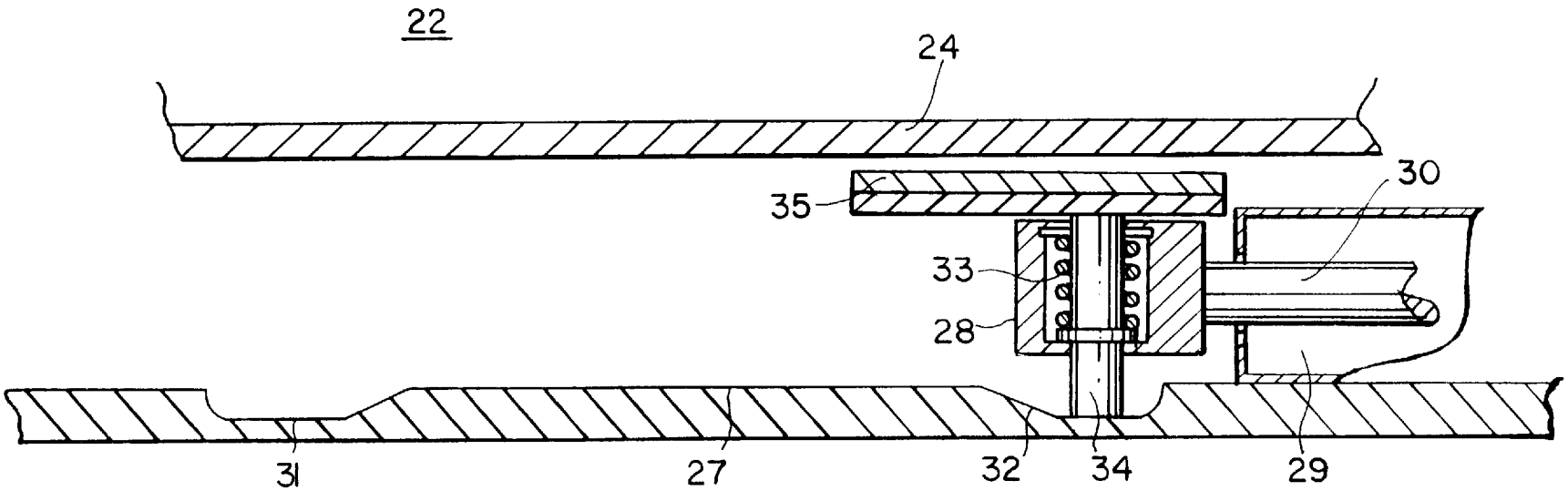
FIGS. 4 to 6 show side views—in partial section—of consecutive stages of an axial displacement of a sleeve on the cylinder for removal.
Figure 5:
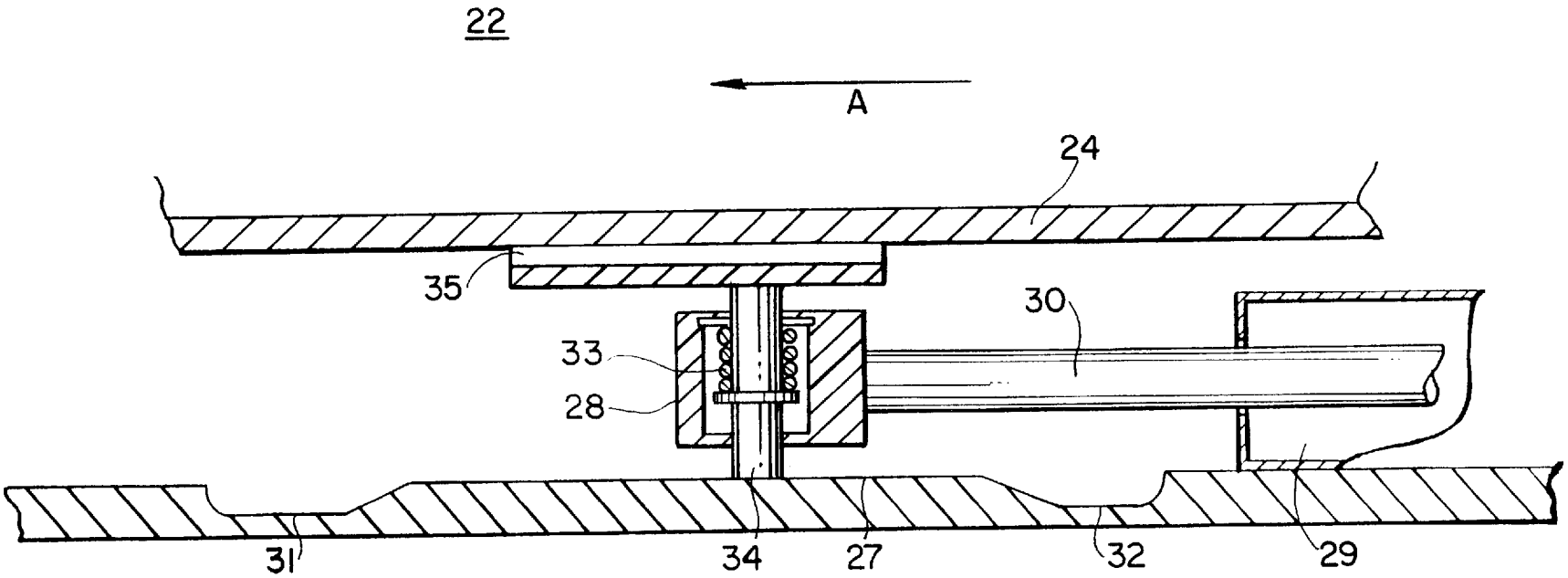
Figure 6:
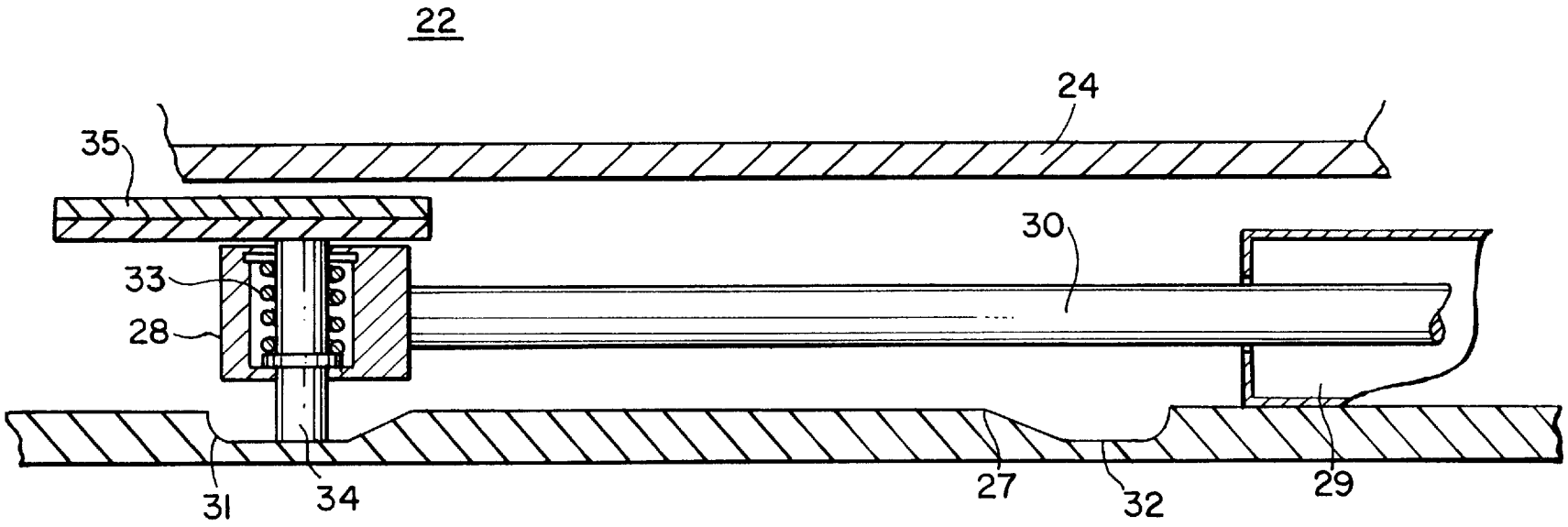

The sleeve gripping system 27, 28, 29, 30 for displacing the sleeve 24 is shown in more detail in FIGS. 4 to 6.

The distance by which the sleeve 24 is displaced on the cylinder 22 is determined on the one hand by the length of the piston rod 30 and, on the other hand, is defined by grooves 31, 32 located on the rail-shaped guide 27. The guide member 28 for contacting the sleeve 24 is constructed as a clamping piece and has a control pin 34 which is movable vertically with respect to the cylinder axis against a pressure spring 33. When the guide member 28 is moved on the guide 27 by the piston rod 30, the control pin 34 senses the groove geometry 31, 32 and raises or lowers a friction lining 35, which is attached on its other side to the guide member 28, relative to the sleeve 24 depending on the groove geometry 31, 32.

Thus, when the sleeve 24 mounted on the cylinder 22 is to be removed, the pneumatic pressing fit of the sleeve 24 is usually canceled by supplying compressed air from compressed air supply means 50 so that the sleeve 24 can be displaced along the cylinder 22 on a cushion of air. Such compressed air supply means, including their construction and operation, are known to those skilled in the art. Thus, a more detailed description thereof is not provided. The piston rod 30 of the drive 29 is moved out and the control pin 34 is raised against the pressure spring 33 by the change in the geometry of the groove 32 from the lower groove level to the upper groove level so that the friction lining 35 is pressed against the sleeve 24 (FIG. 5).

The sleeve 24 is carried along by the guide member 28 as its continues its linear movement in the push-out direction (arrow A).

Due to the groove geometry 31, the control pin 34 moves again in the direction away from the sleeve 24 and contact between the friction lining 35 and the sleeve 24 is interrupted (FIG. 6).

The sleeve 24 can be displaced on the cylinder 22 between the sides walls 20, 21 along this defined path between grooves 31 and 32 until it can be easily pulled out of the printing mechanism from the cylinder 22 manually or in a fully automatic manner.

The sleeve is assembled by following this sequence of steps in reverse.

Obviously, the contact between the sleeve 24 and guide member 28 required for axial displacement of the sleeve 24 on the cylinder 22 can also be produced by means of vacuum suction devices or, within the broadest sense, by a hook.

The steps according to the invention achieve a considerable reduction in set-up times.

The invention is not limited by the embodiments described above which are presented as examples only but can be modified in various ways within the scope of protection defined by the appended patent claims.

We claim:

1. A device for manipulating a printing form sleeve or rubber blanket sleeve on a cylinder that is cantilever mounted horizontally in a rotary printing machine while the cylinder is horizontally mounted between side walls of the printing machine, the cylinder having an axis, the device comprising:

force means for engaging the sleeve within the printing machine; and sleeve gripping means for activating the force means to grip the sleeve within the printing machine in a frictional manner, so that the entire sleeve, when gripped, is selectively displaceable axially on the cylinder in either axial direction while the sleeve is between the side walls of the printing machine so that the sleeve is correctly positionable on the cylinder, the sleeve gripping means including a guide rail horizontally mountable between the side walls of the printing machine so as to extend parallel to the cylinder axis, a guide member displaceably mounted on the guide rail so as to be engageable with the sleeve for moving the sleeve between the side walls, and a drive articulated to the guide member to displace the guide member.

2. A device for manipulating a sleeve on a cylinder according to claim 1, and further comprising paper web swiveling means for swiveling a paper web, which has been drawn into the printing machine, away from the cylinder.

3. A device for manipulating a sleeve on a cylinder according to claim 2, wherein the paper web swiveling means includes at least one swivel arm and a strip articulated to an end of the swivel arm and parallel to an axis of the cylinder, the swivel arm being arranged to move the paper web away from the cylinder via the strip.

4. A device for manipulating a sleeve on a cylinder according to claim 3, wherein the swivel arm is a pneumatic cylinder having a piston rod to which the strip is articulated so that the paper web can be pressed away from the cylinder.

5. A device for manipulating a sleeve on a cylinder according to claim 2, wherein separate paper swiveling means are arranged at each side of the paper web passing through a printing gap between two cylinders so that the paper web can be swiveled away from a first one of the cylinders and simultaneously pressed against a second one of the cylinders when the cylinders are disconnected from printing operation.

6. A device for manipulating a sleeve on a cylinder according to claim 1, and further comprising means for supplying compressed air between the sleeve and the cylinder so that an air cushion is provided on which the sleeve is displaced.

7. A device for manipulating a sleeve on a cylinder according to claim 1, wherein the drive includes a pneumatic cylinder and a piston rod articulated to the guide member so that the sleeve is movable on the cylinder by a defined distance.

8. A device for manipulating a sleeve on a cylinder according to claim 1, wherein the force means is a friction lining, the friction lining being mounted on the guide member, the guide member having a control pin and a pressure spring that surrounds the control pin, the control pin being adapted to be movable vertically relative to the cylinder axis against the pressure spring for contacting the friction lining against the sleeve, the guide rail being provided with grooves that have a geometry which controls the vertical movement of the control pin so that the friction lining on the guide member can be brought into contact with the sleeve and moved away from the sleeve by upward and downward motion of the control pin.

* * * * *